US006112708A

United States Patent [19]

Sawada et al.

[11] Patent Number: 6,112,708

[45] Date of Patent: Sep. 5, 2000

[54] STRATIFIED SCAVENGING TWO-CYCLE ENGINE

[75] Inventors: Toshiharu Sawada, Fuchu; Hiroshi Kato, Hachioji; Takeshi Watanabe, Houya, all of Japan

[73] Assignee: Komatsu Zenoah Co., Tokyo, Japan

[21] Appl. No.: 09/255,233

[22] Filed: Feb. 22, 1999

[30] Foreign Application Priority Data

Oct. 30, 1998 [JP] Japan ..... 10-324465

[51] Int. Cl.[7] ..... F02B 25/20; F02B 33/04; F02M 19/00

[52] U.S. Cl. ..... 123/73 PP

[58] Field of Search ..... 123/73 PP, 73 A, 123/73 AF, 73 F, 65 VB, 65 P

[56] References Cited

U.S. PATENT DOCUMENTS 4,248,185 2/1981 Jaulmes ..... 123/73 PP
4,398,509 8/1983 Offenstadt et al. ..... 123/73 AF
4,777,913 10/1988 Staerzl et al. ..... 123/73 A
5,503,119 4/1996 Glover ..... 123/73 PP

*Primary Examiner*—Marguerite McMahon
*Attorney, Agent, or Firm*—Sidley & Austin

[57] ABSTRACT

A stratified scavenging two-cycle engine, which enables a reduction in size and an improvement in productivity, includes a carburetor (6), which is provided between an air cleaner (7) and a suction fitting (4), wherein a mixture flow passage (6B) and an air flow passage (6A) are formed in the carburetor at least generally in parallel with each other, an air control valve (6*a*) is disposed in the air flow passage in the carburetor, and a mixture control valve (6*b*) is disposed in the mixture flow passage in the carburetor so that the carburetor and the valves (6*a* and 6*b*) constitute a single unit. The suction fitting (4), which is provided between the carburetor (6) and the closest outer face of the cylinder block (2), is a single piece and contains an air flow passage (4*a*), which is fluidly connected to the air flow passage (6A) in the carburetor (6) and to scavenging ports (2*a*) in the cylinder block, and a mixture flow passage (4*b*), which is fluidly connected to the mixture flow passage (6B) in the carburetor (6) and to a chamber in a crankcase (3).

20 Claims, 9 Drawing Sheets

STRATIFIED SCAVENGING TWO-CYCLE ENGINE

BACKGROUND ART

An example of a conventional stratified scavenging two-cycle engine is disclosed in Japanese Patent Laid-open No. 9-268917; and FIG. 12 herein shows a side sectional view of a stratified scavenging two-cycle engine 10 as described in the aforesaid Japanese Patent Laid-open. In FIG. 12, a muffler 80 is attached to an exhaust port 26, which is formed in a cylinder block 20 of the engine 10. Formed in an outer face of a crankcase 90, attached to the underside of the cylinder block 20, is a suction port 90*a* for sucking mixture into a crank chamber within the crankcase 90. A heat insulating pipe (suction pipe) 40 is connected to the suction port 90*a*, and a carburetor 60 is connected to the heat insulating pipe 40. An air control valve 50 is provided between the carburetor 60 and an air cleaner 70. The air control valve 50 is connected via an air supply pipe 55 to a scavenging port 20*a*, which is provided in the cylinder block 20. A check valve 20*b* is provided in the scavenging port 20*a* in the cylinder block 20. An ignition plug 30 is attached to the top of the cylinder block 20. A length, in a cross direction between an outer face of the air cleaner 70 and the outer face of the cylinder block 20 which is closest to the air cleaner 70, is set to be a dimension LA.

However, in the aforesaid art the air control valve 50 is provided between the carburetor 60 and the air cleaner 70. Therefore, the dimension LA, in a cross section between the outer face of the air cleaner 70 and the closest outer face of the cylinder block 20, is long, and the space required by the stratified scavenging two-cycle engine 10 is large. Consequently, there arises a disadvantage in that the workability of a shoulder hanging, hand-held, or knapsack-type mower for mowing grass, a chain saw, or the like, incorporating the engine 10 is inferior.

The distance from the air control valve 50 to the scavenging port 20*a* of the cylinder block 20 is long. Therefore, the air supply pipe 55 is made long, which results in a lack of compact disposition. In addition, there is a disadvantage in that the air supply pipe 55 is a hindrance to a workman because it can touch his body. There is another disadvantage in that the air control valve 50 and the carburetor 60 are manufactured separately, thus causing high manufacturing costs. Moreover, since the check valve 20*b* is provided within the cylinder block 20 in the engine assembly process, the productivity is low.

SUMMARY OF THE INVENTION

In view of the aforesaid disadvantages, an object of the present invention is to provide a stratified scavenging two-cycle engine which enables a reduced engine size, a compact disposition, an improvement in the workability of a mower, a chain saw, or the like, which incorporates the stratified scavenging two-cycle engine, and/or an improvement in productivity.

A stratified scavenging two-cycle engine according to the present invention is characterized as a stratified scavenging two-cycle engine which includes: a piston; a cylinder block having a cylinder chamber in which the piston is disposed to be vertically slidable; a crankcase, which is connected to the cylinder block; a scavenging flow passage, having an scavenging port formed in a side wall of the cylinder block, for connecting the scavenging port and a crank chamber in the crankcase; an air supply flow passage, connected to the scavenging flow passage for supplying air through a check valve; a carburetor, for supplying mixture into the crank chamber through a suction fitting; and an air cleaner connected to the carburetor; wherein the carburetor is provided between the air cleaner and the suction fitting; wherein an air flow passage, forming a part of the air supply flow passage, and a mixture flow passage are formed in the carburetor at least generally in parallel within each other; wherein an air control valve is disposed in the air flow passage in the carburetor and a mixture control valve is disposed in the mixture flow passage in the carburetor; wherein the suction fitting is a single element which is provided between the carburetor and an outer face of the cylinder block; and wherein an air flow passage is formed in the suction fitting for fluid connection to the air flow passage in the carburetor and a mixture flow passage is formed in the suction fitting for fluid connection to the mixture flow passage in the carburetor.

According to the aforesaid configuration, the mixture flow passage and the air flow passage are formed in the carburetor at least generally in parallel with each other; the air control valve is disposed in the air flow passage and the mixture control valve is disposed in the mixture flow passage; and the carburetor is attached to the outer face of the cylinder block via the suction fitting, which serves also as a heat insulating material. Consequently, the dimension in a cross section between the outer face of the air cleaner and the closest outer face of the cylinder block is made smaller, thereby reducing the space required by the stratified scavenging two-cycle engine as well as the size thereof. Accordingly, the handling of a shoulder hanging, hand-held, or knapsack-type mower for mowing grass, a chain saw, or the like, incorporating the stratified scavenging two-cycle engine according to the present invention, is facilitated, thereby improving the workability. In addition, the carburetor, the air control valve, and the mixture control valve can be integrally formed as a single unit, thus decreasing the number of parts and lowering the manufacturing costs.

It is also possible that the suction fitting has a plurality of exhaust ports for exhausting air, that a plurality of the scavenging flow passages are provided in the cylinder block, and that a respective one of the plurality of exhaust ports and the corresponding one of the plurality of scavenging flow passages are connected via a respective one of a plurality of air supply pipes.

According to the aforesaid configuration, as to the conventional disadvantages shown in FIG. 12, each air flow passage in the suction fitting, which is attached directly to the outer face of the cylinder block, is connected to a scavenging flow passage in the cylinder block via an air supply pipe, whereby the air supply pipes can be made shorter and more compact and a satisfactory piping can be obtained. As a result, the conventional disadvantage in that "the air supply pipe is a hindrance to a workman because it can touch his body" is eliminated, thus improving the workability and lowering the manufacturing costs.

A plurality of connecting pipes can be disposed between the plurality of air supply pipes and the plurality of scavenging flow passages, and each one of the check valves can be provided in a respective one of the plurality of connecting pipes.

According to the latter configuration, as against the conventional configuration in which "the check valve is disposed in the cylinder block", the check valve is provided in the connecting pipe, thereby decreasing the number of parts involved in the assembly of the engine. Consequently, assembly man-hours in the engine assembly process are decreased and productivity can be improved.

BEST MODE FOR CARRYING OUT THE INVENTION

A preferable embodiment of a stratified scavenging two-cycle engine according to the present invention will be described in detail with reference to the attached drawings.

Figure 1:
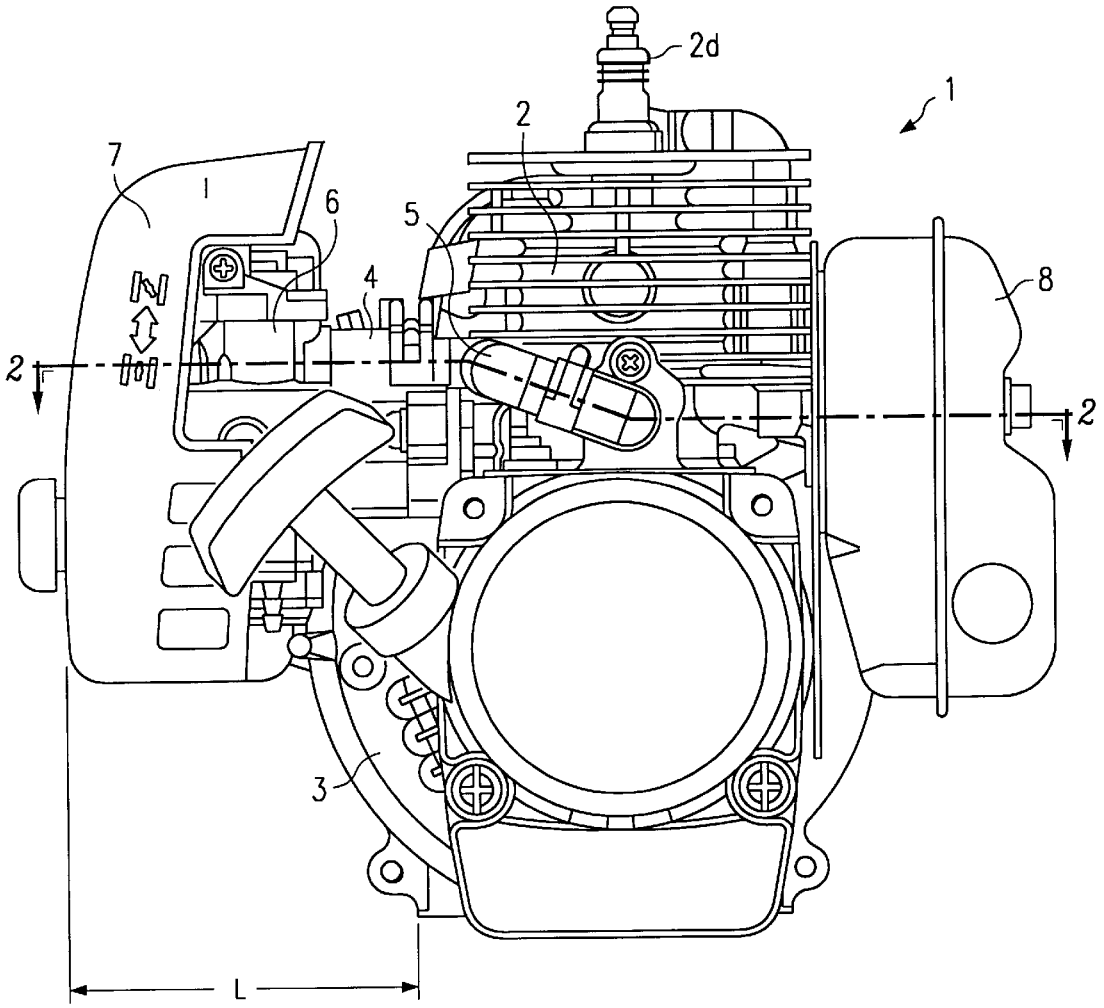
FIG. 1 is a front view of a stratified scavenging two-cycle engine according to the present invention.
Figure 2:
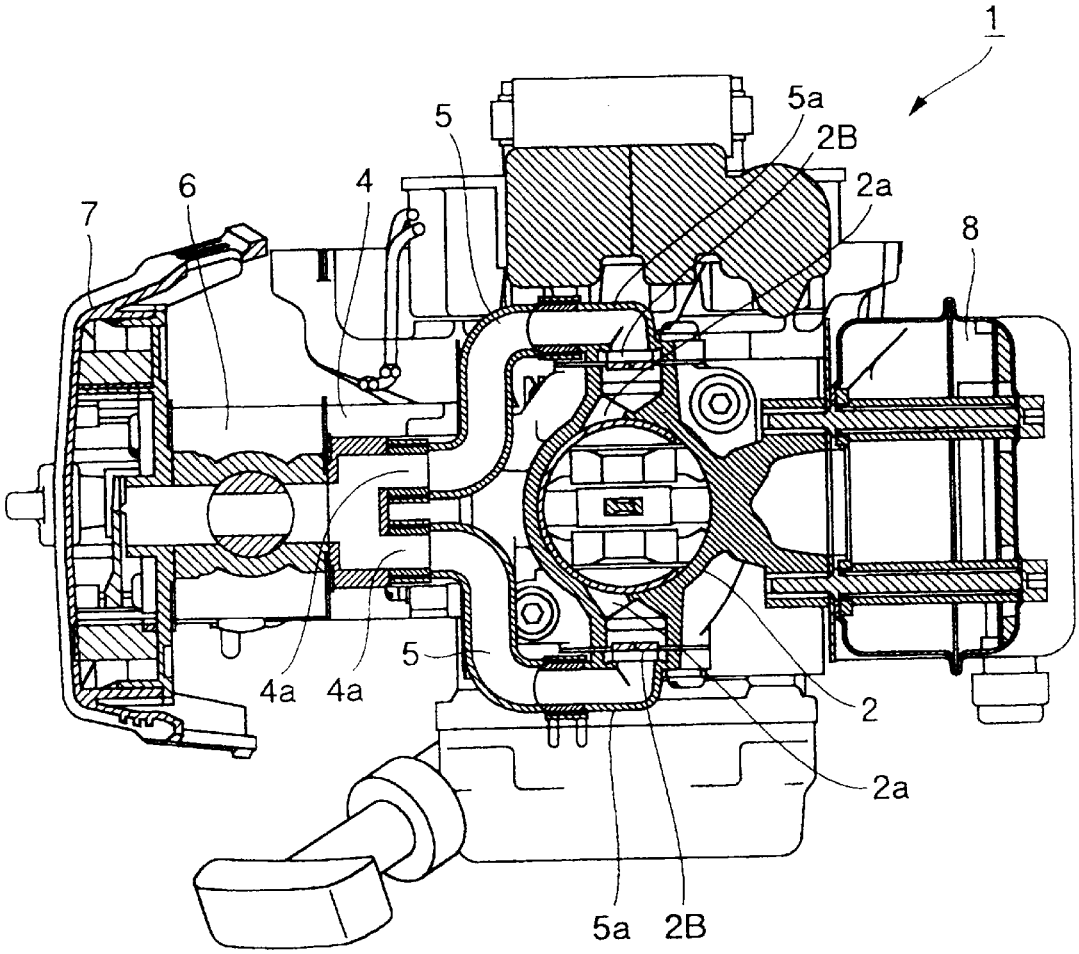
FIG. 2 is a sectional view taken along the line 2—2 in FIG. 1.
Figure 3:
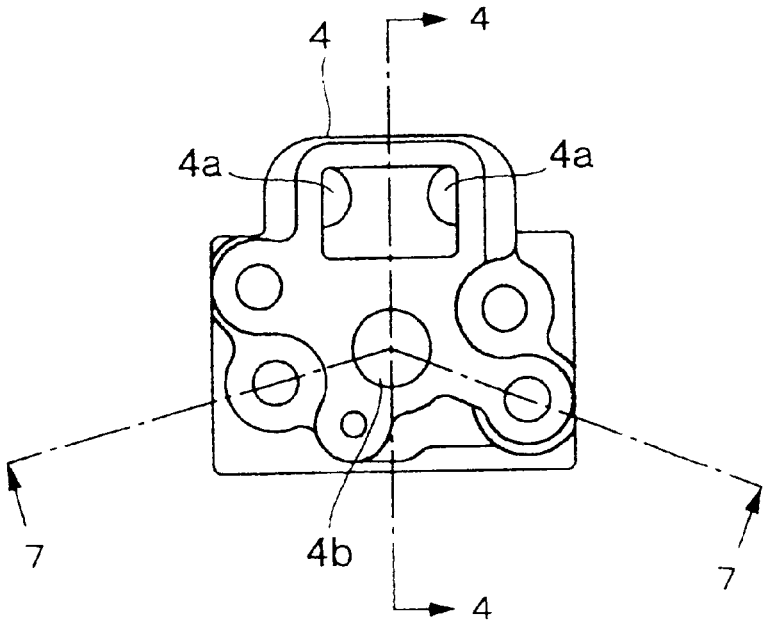
FIG. 3 is a front view of a suction fitting according to the present invention.
Figure 4:
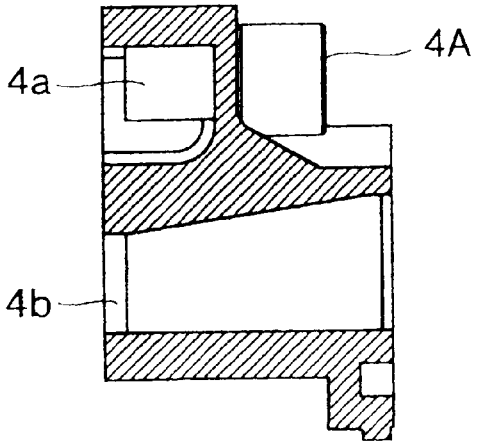
FIG. 4 is a sectional view taken along the line 4—4 in FIG. 3.
Figure 5:
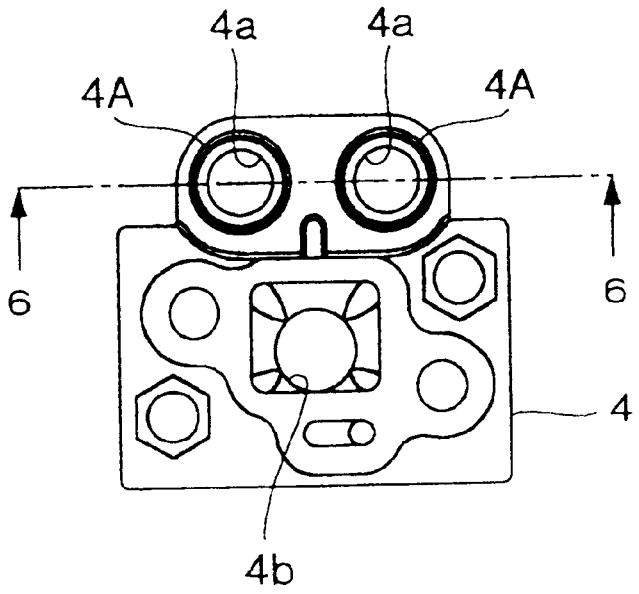
FIG. 5 is a rear view of the suction fitting in FIG. 3.
Figure 6:
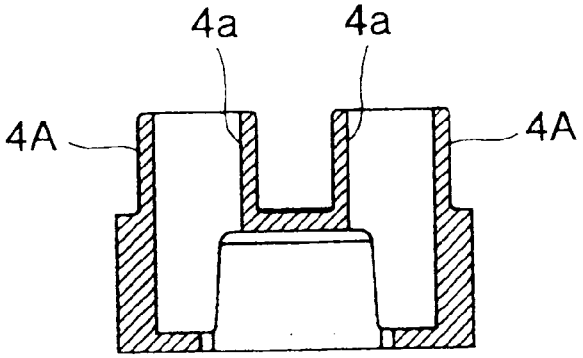
FIG. 6 is a sectional view taken along the line 6—6 in FIG. 5.
Figure 7:
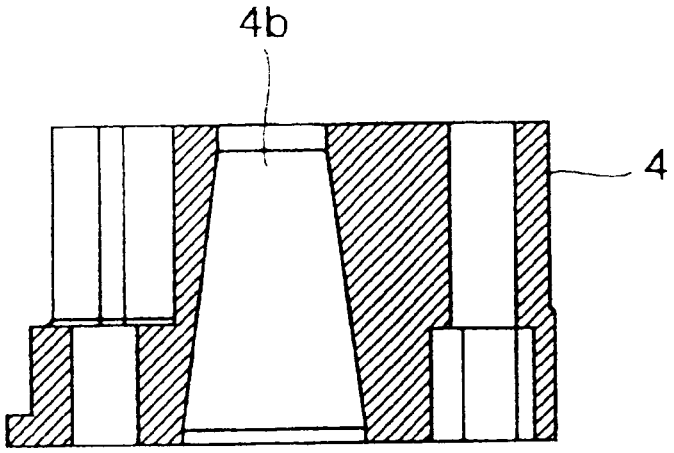
FIG. 7 is a sectional view taken along the line 7—7 in FIG. 3.
Figure 8:
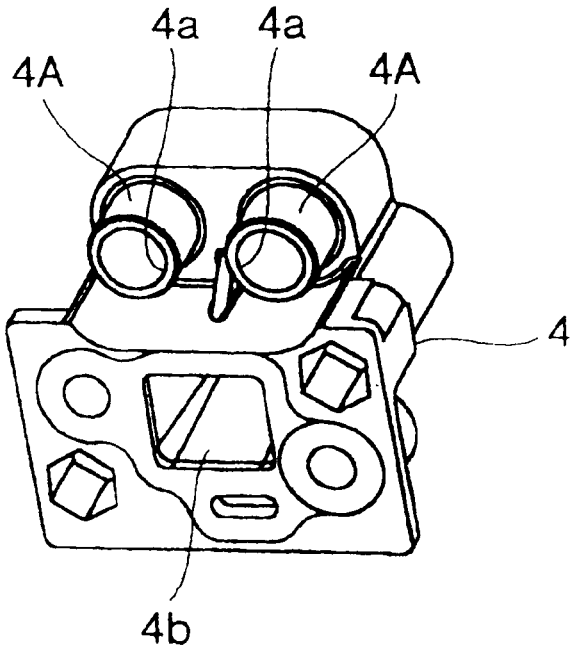
FIG. 8 is a perspective view of the suction fitting in FIG. 3.

A schematic configuration of a stratified scavenging two-cycle engine 1 will be explained on the basis of FIGS. 1 and 2. A piston 2A (see FIG. 11) is disposed to be vertically slidable in a cylinder chamber formed in the cylinder block 2 for the stratified scavenging two-cycle engine 1. An exhaust port (not shown) is provided in the right side face of the cylinder block 2, and a muffler 8 is attached to the cylinder block 2 by suitable means, e.g., bolts, etc., so as to provide a fluid connection with the exhaust port. A suction fitting 4 is connected between the left side face of the cylinder block 2 and a carburetor 6 by suitable means, e.g. bolts, etc.; and an air cleaner 7 is attached to an outer face of the carburetor 6 by suitable means, e.g. one or more bolts or latches.

A crankcase 3 is connected to the underside of the cylinder block 2 by suitable means, e.g. bolts, etc. An ignition plug 2*d* is attached to the top of the cylinder block 2. A length between the left side outer face of the cylinder block 2 and the outer face of the air cleaner 7 is a dimension L. Air flow passages 4*a* and 4*a*, which are formed in the suction fitting 4, are fluidly connected to the air supply pipes 5 and 5, respectively. The air supply pipes 5 and 5 are fluidly connected via connecting pipes 5*a* and 5*a*, respectively, to plural scavenging flow passages 2*b* and 2*b* (see FIG. 11), which are formed in the cylinder block 2.

The configuration of the suction fitting 4 will be explained with reference to FIGS. 1 through 8. The suction fitting 4 is a single piece element having the air flow passages 4*a* and 4*a* and a mixture flow passage 4*b* formed therein by suitable means, e.g. by molding, drilling, etc. The air flow passages 4*a* and 4*a* are fluidly connected via the air exhaust ports 4A and 4A, the air supply pipes 5 and 5, and the connecting pipes 5*a* and 5*a*, respectively, to the plural scavenging flow passages 2*b* and 2*b* (see FIG. 11), which are formed in the cylinder block 2. The mixture flow passage 4*b* is fluidly connected to a mixture supply flow passage (not shown) which is provided in the cylinder block 2.

Figure 9:
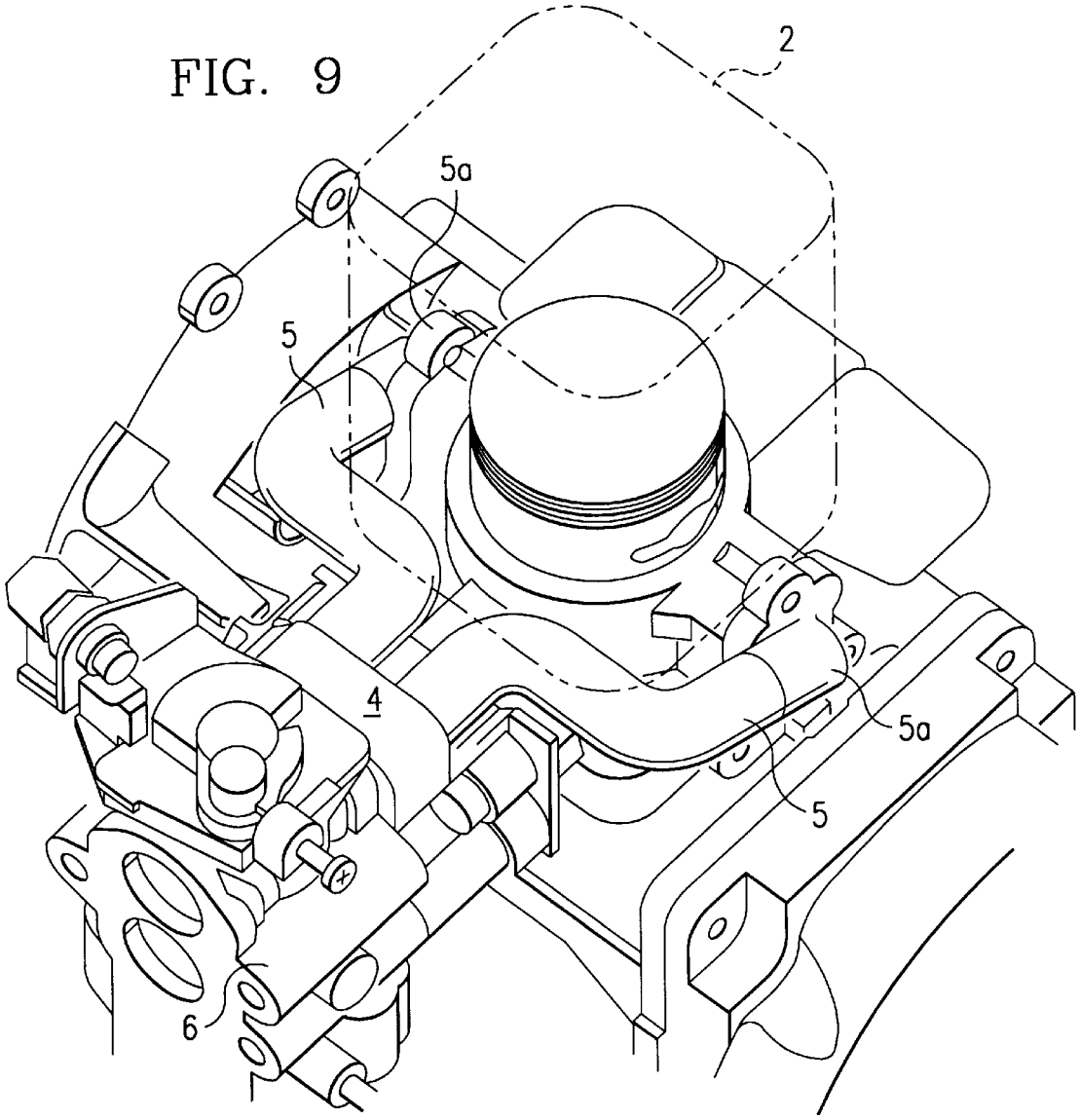
FIG. 9 is a perspective view of principal portions of a carburetor, the suction fitting, the air supply pipes, and the connecting pipes according to the present invention.

In FIG. 9, the suction fitting 4 is attached directly to the carburetor 6, and the air flow passages 4*a* and 4*a* in the suction fitting 4 are fluidly connected to the plural scavenging flow passages 2*b* and 2*b* (see FIG. 11) via the plural air supply pipes 5 and 5 and the connecting pipes 5*a* and 5*a*, respectively. Each of the connecting pipes 5*a* and 5*a* has a check valve 2B (see FIG. 2) therein. The air supply pipes 5 and 5 can be made of metal, but if they are made with more flexible materials, the assembling becomes easier, thus improving the productivity.

Figure 10:
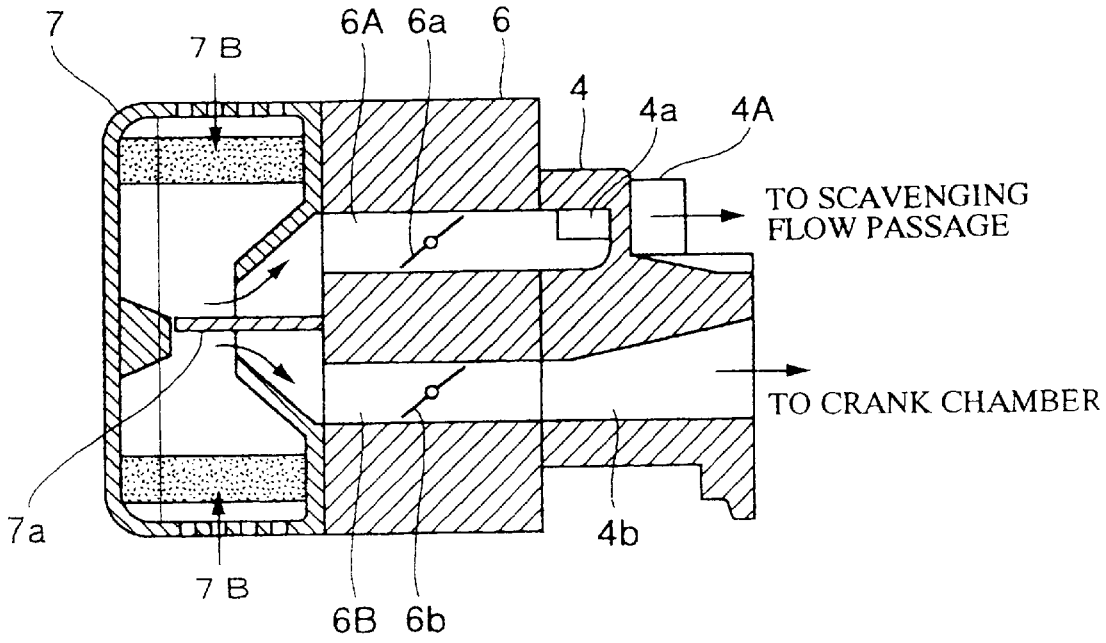
FIG. 10 is a fragmentary sectional view for explaining an air cleaner, the carburetor, and the suction fitting according to the present invention.

The present invention will be explained with reference to FIGS. 1 through 11. As shown in FIG. 10, the air control valve 6*a* and the mixture control valve 6*b* are integrally formed within the carburetor 6 so that the carburetor 6 and the valves 6*a* and 6*b* constitute a single unit, and the carburetor 6 and the single piece suction fitting 4 are connected directly together by suitable means, e.g., bolts, etc., so that the air flow passage 6A in the carburetor 6 is fluidly connected to the air flow passages 4*a* and 4*a* in the suction fitting 4, and so that the mixture flow passage 6B in the carburetor 6 is fluidly connected to the mixture flow passage 4*b* in the suction fitting 4. The flow of air 7B, which is introduced into the air cleaner 7, is branched into two flow paths by a shielding plate 7*a*, which is provided almost at the center of the air cleaner 7, and the air 7B continues toward the carburetor 6 along the directions shown by the arrows in FIG. 10. In the carburetor 6, which is directly connected to the air cleaner 7, the air flow passage 6A and the mixture flow passage 6B are formed to be at least generally parallel to each other. Mixture, generated by fuel and part of the air 7B, flows through the mixture flow passage 6B. In addition, the air flow passage 6A is provided with the air control valve 6*a* therein, and the mixture flow passage 6B is provided with the mixture control valve 6*b* therein.

Accordingly, in the flow passages 6A and 6B in the carburetor 6, the respective control valves 6*a* and 6*b* are integrally formed. The suction fitting 4 includes the air flow passages 4*a* and 4*a* and the mixture flow passage 4*b*. The air flow passages 4*a* and 4*a* are fluidly connected to the air flow passage 6A, and the mixture flow passage 4*b* is fluidly connected to the mixture flow passage 6B. Mixture flows from the mixture flow passage 4*b* via a mixture supply flow passage (not shown), provided in the cylinder block 2, into a crank chamber (not shown) in the crankcase 3.

Figure 11:
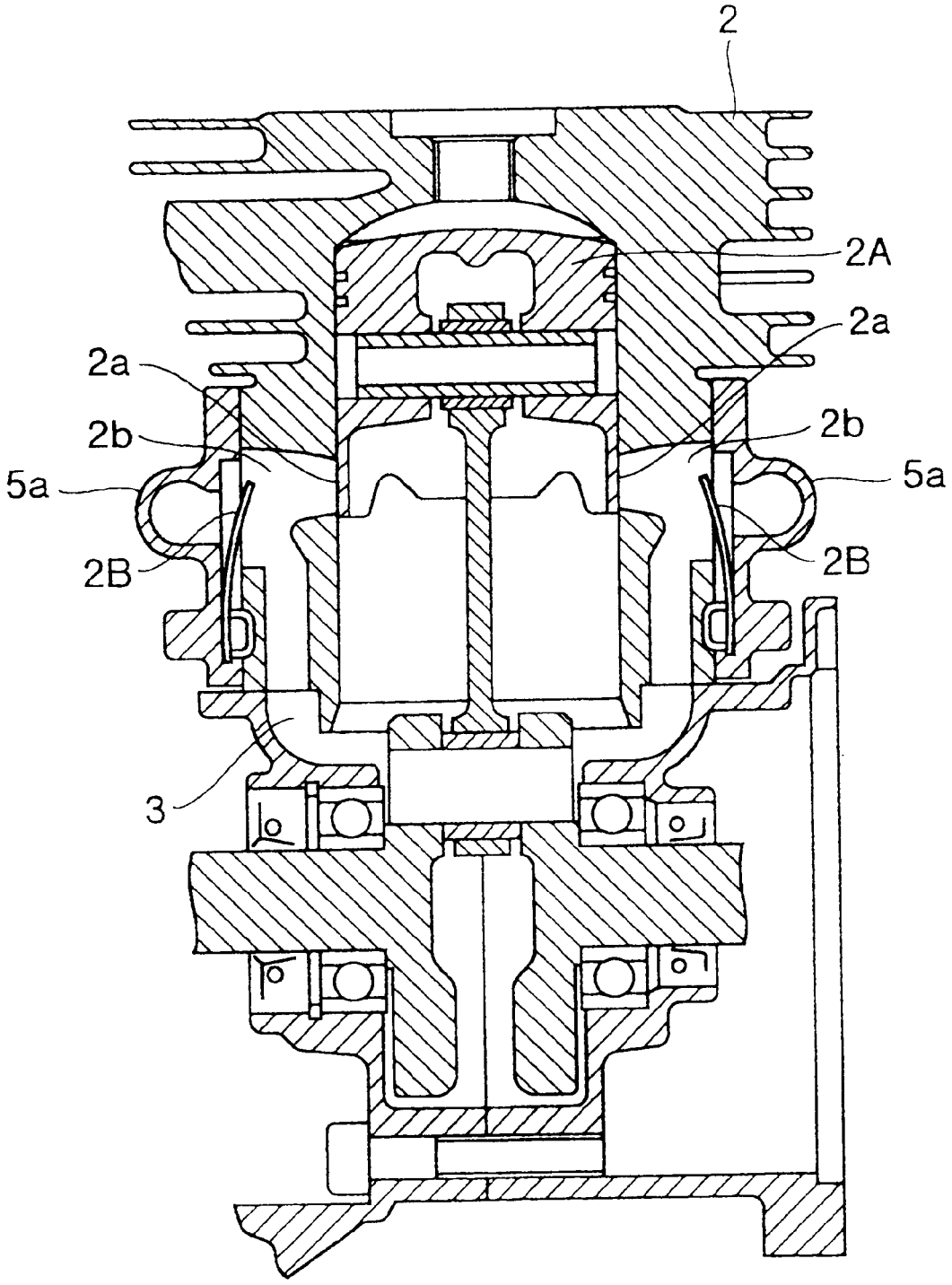
FIG. 11 is a sectional view of a cylinder block according to the present invention.

The suction fitting 4 is connected to the outer face of the cylinder block 2 by suitable means, e.g., bolts, etc., so that part of the air 7B flows from the air exhaust ports 4A, located at the ends of the air flow passages 4*a* in the suction fitting 4, through the air supply pipes 5 and 5 (see FIG. 2), and the connecting pipes 5*a* and 5*a* (shown in FIG. 11). The connecting pipes 5*a* and 5*a* respectively communicate with the plural scavenging flow passages 2*b* and 2*b*, which are provided in the cylinder block 2. The check valves 2B and 2B are provided between the connecting pipes 5*a* and 5*a* and the scavenging flow passages 2*b* and 2*b*, respectively, are preferably part of the connecting pipes 5*a* and 5*a* rather than part of the cylinder block 2. Plural scavenging ports 2*a* and 2*a*, provided in the cylinder block 2, are connected to the crank chamber in the crankcase 3 via the scavenging flow passages 2*b* and 2*b*, respectively. Suction and scavenge of air are conducted by way of the scavenging flow passages 2*b* and 2*b* and the scavenging ports 2*a* and 2*a* in synchronization with the upward and downward movements of the piston 2A, which is disposed to be vertically slidable in the cylinder chamber in the cylinder block 2. The check valves 2B and 2B operate to allow part of the air 7B, which is introduced along the directions of the arrows shown in FIG. 10, to flow through the air flow passages 4*a* and 4*a* in the suction fitting 4, the air supply pipes 5 and 5, the connecting pipes 5*a* and 5*a*, and the scavenging flow passages 2*b* and 2*b*, respectively, but not to allow combustion gas in the cylinder block 2 to flow into the connecting pipes 5*a* and 5*a*.

As described above, in the stratified scavenging two-cycle engine 1 of the present invention, the carburetor 6, the air control valve 6*a*, and the mixture control valve 6*b* are integrally formed as a single unit. Moreover, in the stratified scavenging two-cycle engine 1, the carburetor 6 is attached to the outer face of the cylinder block 2 through the suction fitting 4, which serves also as a heat insulating material, thereby shortening the dimension L in a cross direction between the outer face of the air cleaner 7 and the closest outer face of the cylinder block 2, and making the space required by the engine 1 smaller as shown in FIG. 1.

Consequently, the handling of a shoulder hanging, hand-held, or knapsack-type mower for mowing grass, a chain saw, or the like with the stratified scavenging two-cycle engine 1 is facilitated, thereby improving workability. In addition, the carburetor 6, the air control valve 6*a*, and the mixture control valve 6*b* are integrally formed as a single unit, thus decreasing the number of parts and assembly man-hours and lowering manufacturing costs.

Figure 12:
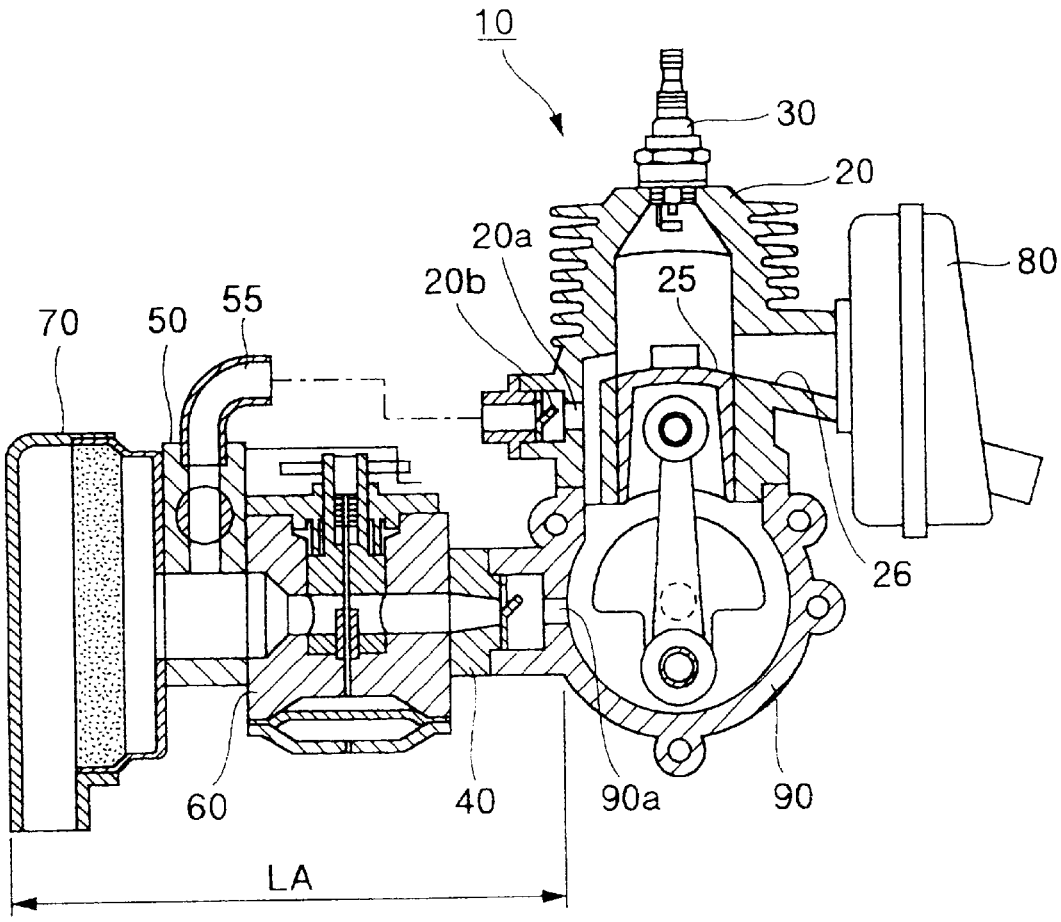
FIG. 12 PRIOR ART
FIG. 12 is a side sectional view of a stratified scavenging two-cycle engine according to a prior art.

Hitherto, as shown in FIG. 12, there has been a disadvantage in that a satisfactory disposition could not be obtained since the air supply pipe 55 is long due to the long distance from the air control valve 50 to the scavenging port 20*a* of the cylinder block 20. In contrast, in the present invention, the suction fitting 4 is attached to the outer face of the cylinder block 2, and the scavenging flow passages 2*b* and 2*b* are fluidly connected via the air supply pipes 5 and 5, thereby shortening the air supply pipes 5 and 5 and obtaining a satisfactory disposition. As a result, the conventional disadvantage in that the air supply pipes 55 are hindrances to a workman because they can touch his body is eliminated, thus improving the workability and lowing the manufacturing costs.

Moreover, since the check valves 2B and 2B are provided in the connecting pipes 5*a* and 5*a* respectively, assembly man-hours in the engine assembly process are decreased, thereby improving productivity.

Reasonable variation and modifications are possible within the scope of the foregoing description, the drawings and the appended claims to the invention.

What is claimed is:

1. A stratified scavenging two-cycle engine comprising:

a piston;

a cylinder block, containing a cylinder chamber in which said piston is disposed so as to be slidable;

a crankcase, connected to said cylinder block and containing a crankcase chamber;

a scavenging flow passage, having a scavenging port formed in a side wall of said cylinder block, for connecting said scavenging port and said crankcase chamber;

a check valve;

an air supply flow passage fluidly connected to said scavenging flow passage for supplying air through said check valve;

a suction fitting;

a carburetor for supplying mixture into said crankcase chamber via said suction fitting; and an air cleaner connected to said carburetor;

wherein said carburetor is connected between said air cleaner and said suction fitting;

wherein an air flow passage, forming a part of said air supply flow passage, and a mixture flow passage are formed in said carburetor at least generally in parallel with each other;

wherein an air flow control valve is disposed in said air flow passage in said carburetor;

wherein a mixture control valve is disposed in said mixture flow passage in said carburetor;

wherein said suction fitting is connected between said carburetor and an outer face of said cylinder block;

wherein an air flow passage, formed in said suction fitting, is fluidly connected to said air flow passage in said carburetor; and wherein a mixture flow passage, formed in said suction fitting, is fluidly connected to said mixture flow passage in said carburetor.

2. A stratified scavenging two-cycle engine in accordance with claim 1, wherein said scavenging flow passage is formed in said cylinder block.

3. A stratified scavenging two-cycle engine in accordance with claim 1, wherein said carburetor, said air flow control valve, and said mixture control valve are integrally formed as a single unit.

4. A stratified scavenging two-cycle engine in accordance with claim 1, wherein said air cleaner includes a plate for dividing air, introduced into said air cleaner, into an air flow into said air flow passage in said carburetor and an air flow into said mixture flow passage in said carburetor.

5. A stratified scavenging two-cycle engine in accordance with claim 1, wherein said carburetor is directly connected to said air cleaner and is directly connected to said suction fitting.

6. A stratified scavenging two-cycle engine in accordance with claim 5, wherein said carburetor, said air flow control valve, and said mixture control valve are integrally formed as a single unit.

7. A stratified scavenging two-cycle engine in accordance with claim 6, wherein said air cleaner includes a plate for dividing air, introduced into said air cleaner, into an air flow into said air flow passage in said carburetor and an air flow into said mixture flow passage in said carburetor.

8. A stratified scavenging two-cycle engine in accordance with claim 7, wherein said suction fitting is a single piece.

9. A stratified scavenging two-cycle engine in accordance with claim 1, wherein said suction fitting is a single piece.

10. A stratified scavenging two-cycle engine in accordance with claim 1, wherein:

a plurality of scavenging flow passages, including said scavenging flow passage, are provided in said cylinder block, each having a scavenging port formed in a side wall of said cylinder block, for connecting a respective scavenging port and said crankcase chamber;

said suction fitting has a plurality of air exhaust ports for exhausting air; and each one of said plurality of air exhaust ports and a respective one of said plurality of scavenging flow passages are fluidly connected via a respective one of a plurality of air supply pipes.

11. A stratified scavenging two-cycle engine in accordance with claim 10, further comprising a plurality of connecting pipes, with each one of said connecting pipes being fluidly connected between a respective one of said plurality of air supply pipes and a respective one of said plurality of scavenging flow passages; and a plurality of check valves, including said check valve.

12. A stratified scavenging two-cycle engine in accordance with claim 11, wherein each respective check valve is provided in a respective one of said plurality of connecting pipes.

13. A stratified scavenging two-cycle engine in accordance with claim 12, wherein said carburetor, said air flow control valve, and said mixture control valve are integrally formed as a single unit.

14. A stratified scavenging two-cycle engine in accordance with claim 13, wherein said air cleaner includes a plate for dividing air, introduced into said air cleaner, into an air flow into said air flow passage in said carburetor and an air flow into said mixture flow passage in said carburetor.

15. A stratified scavenging two-cycle engine in accordance with claim 14, wherein said carburetor is directly connected to said air cleaner and is directly connected to said suction fitting.

16. A stratified scavenging two-cycle engine in accordance with claim 15, wherein said suction fitting is a single piece.

17. A stratified scavenging two-cycle engine in accordance with claim 10, wherein said carburetor, said air flow control valve, and said mixture control valve are integrally formed as a single unit.

18. A stratified scavenging two-cycle engine in accordance with claim 17, wherein said suction fitting is a single piece.

19. A stratified scavenging two-cycle engine in accordance with claim 10, wherein said suction fitting is a single piece.

20. A stratified scavenging two-cycle engine in accordance with claim 10, wherein said carburetor is directly connected to said air cleaner and is directly connected to said suction fitting.

* * * * *